United States Patent [19]

Kobayashi

[11] Patent Number: 4,487,378

[45] Date of Patent: Dec. 11, 1984

[54] CORELESS TOILET PAPER ROLL AND METHOD FOR MANUFACTURE THEREOF

[76] Inventor: Masashi Kobayashi, 21-4, Nishimachi, Fujinomiya-shi, Shizuoka-ken, Japan

[21] Appl. No.: 424,626

[22] Filed: Sep. 27, 1982

[30] Foreign Application Priority Data

May 19, 1982 [JP] Japan ..... 57-83200

[51] Int. Cl.[3] ..... B65H 17/00

[52] U.S. Cl. ..... 242/68; 242/67.1 R

[58] Field of Search ..... 242/68, 68.5, 68.3, 242/56 R, 56 A, 66, 67.1 R, 56.2, 56.3, 1

[56] References Cited

U.S. PATENT DOCUMENTS

| | | | |
|---|---|---|---|
| 1,882,012 | 10/1932 | Hires | 242/68.5 |
| 2,361,795 | 10/1944 | Roesen | 242/56 R |
| 2,537,588 | 1/1951 | Husson | 242/66 X |
| 2,688,452 | 9/1954 | Higginbotham | 242/55.1 |
| 2,717,224 | 9/1955 | McConnell et al. | 242/68.5 X |
| 3,134,553 | 5/1964 | Gelleke | 242/56 R |
| 3,720,381 | 3/1973 | Rehme et al. | 242/56 R |
| 3,853,279 | 12/1974 | Gerstein | 242/56 A X |

FOREIGN PATENT DOCUMENTS

| | | | |
|---|---|---|---|
| 426007 | 8/1963 | Japan | 242/56.2 |
| 55-11100 | 7/1979 | Japan . | |
| 54-43963 | 12/1979 | Japan . | |

*Primary Examiner*—Stuart S. Levy
*Assistant Examiner*—Joseph J. Hail, III
*Attorney, Agent, or Firm*—Schwartz & Weinrieb

[57] ABSTRACT

A coreless toilet paper roll having a center hole with alternate radial corners and inwardly bulged portions is manufactured by winding toilet paper on a winding shaft having a polygonal or gear-shaped section to form a roll on the winding shaft and then extracting the winding shaft from the rod. The center hole produced in this way is rigid and safe from collapse. The corners or gear teeth of the winding shaft may be arranged helically on the winding shaft to avoid noise during the winding. The toilet paper may be moistened at the outset of winding to provide a more rigid center hole.

22 Claims, 23 Drawing Figures

CORELESS TOILET PAPER ROLL AND METHOD FOR MANUFACTURE THEREOF

FIELD OF THE INVENTION

This invention relates to a toilet paper roll and a method for manufacturing the same. The toilet paper roll according to this invention is coreless but nevertheless has a center hole through which a roll supporting stem can be inserted to rotatably support the roll on a holder.

BACKGROUND OF THE INVENTION

Generally, a toilet paper roll is manufactured by mounting a slender tubular core such as a paper tube on the winding shaft of a toilet paper manufacturing machine, winding toilet paper on the core to a fixed length, extracting the winding shaft from the roll of toilet paper on the core, and cutting the roll of toilet paper into a number of toilet paper rolls of a fixed width. Alternatively, a toilet paper roll may be manufactured by winding a long strip of toilet paper of a fixed width on a tubular core of the same width as the toilet paper. In the toilet paper roll thus obtained, a center hole is secured by means of the tubular core, so that the roll can be rotatably held in position within a toilet paper holder by inserting a roll supporting stem through the tubular core and causing this stem to be supported at the opposed ends thereof on the holder.

However, the manufacturing cost of the toilet paper roll increases by the cost of the paper tube and in addition, when the toilet paper is used up, the core remains, sometimes resulting in inconveniences as, for example, the core is thrown into the toilet bowl and stops up the toilet.

To this end, coreless toilet paper rolls and methods for the manufacture thereof have been proposed in Japanese Patent Publication Nos. 42-6007 and 55-11100, and Japanese Utility Model Publication No. 54-43963. These methods comprise loosely winding at the outset a sheet of toilet paper on a circular winding shaft of a small diameter in a toilet paper roll manufacturing machine, then tightly winding the toilet paper till the paper is terminated, extracting the winding shaft to form the roll of toilet paper, and cutting the roll of toilet paper into suitably sized rolls of a predetermined width. In this case, because the toilet paper is loosely wound at the outset, the winding shaft can easily be extracted. In the center of the toilet paper roll thus manufactured, a hole is formed by extracting the winding shaft, and a small diameter stem is inserted therethrough thereby allowing the roll to be rotatably supported on the holder. However, since the toilet paper is loosely wound at the beginning as described above, the hole collapses and almost disappears under the pressure on the roll when the long roll of toilet paper is cut into short rolls. Therefore it becomes difficult to insert a shaft into the hole in order to support the roll on a holder. Moreover, the absence of a center hole makes the appearance of such roll deviate from the commonly accepted concept of "toilet paper" thus reducing its commercial value.

OBJECT OF THE INVENTION

It is an object of the present invention to provide a coreless toilet paper roll having a center hole for receiving the roll-supporting stem of a holder and a method for the manufacture of such a roll.

SUMMARY OF THE INVENTION

To accomplish the object described above according to the present invention, there is provided a coreless toilet paper roll comprising an approximately polygonal center hole which is formed by means of cornered or roundish constrictions extended radially, and inwardly bulged portions each formed between the adjacent constrictions. The center hole of the toilet paper roll is ensured against collapse by the radially extended constrictions and the bulged portions.

The toilet paper roll according to the present invention is manufactured by the steps of winding toilet paper on a winding shaft having the cross-sectional shape of a polygonal or of a toothed wheel to obtain a roll of toilet paper on the winding shaft, and extracting the winding shaft from the winding of toilet paper thereby forming the center hole into a shape similar to the winding shaft and then causing the straight-line portions between adjacent angled portions corresponding to the corners on the outer surface of the winding shaft to be bulged inwardly to form cornered or roundish constrictions between the adjacent angled portions.

In the toilet paper roll, when the toilet paper is tightly wound under pressure on the winding shaft having corners or teeth on its outer surface and the winding shaft is extracted after completion of winding, the straight-line portions between the angled portions formed by the corners or teeth of the winding shaft are inwardly bulged by centripetal pressure in the roll resulting from the tight winding of the paper on the winding shaft. The adjacent bulged portions press onto one another to maintain an asterisk-shaped center hole which does not collapse. The so-formed center hole allows the roll to be held more firmly on the holder stem than is possible with circular center hole formed by loose winding.

Since no paper tube is used as the core of the toilet paper roll, the roll can be reduced in cost and it is possible to avoid the various inconveniences caused by the core which remains after the toilet paper is used up.

Since the winding shaft on which the toilet paper is wound to obtain the roll according to this invention is polygonal in shape, when the winding shaft is rotated with a pressure roller in contact therewith, vibration and noise occur at the outset of winding. To eliminate these, the corners or teeth on the winding shaft may be arranged helically in the axial direction, thereby enabling the toilet paper to be smoothly wound on the shaft.

In addition, in order to completely prevent the inner peripheral surface of the center hole of the toilet paper roll from being deformed, water or a solution containing an adhesive can be applied to the toilet paper at the outset of winding on the winding shaft, whereby the center hole may be completely secured.

BRIEF DESCRIPTION OF THE DRAWINGS

Other objects and features of the present invention will be apparent from the ensuing detailed description in connection with the accompanying drawings, wherein.

DESCRIPTION OF THE ILLUSTRATED EMBODIMENTS

The present invention relates to a coreless toilet paper roll having a firm center hole into which a holder stem is inserted to support the roll thereon and a method for the manufacture thereof.

Figure 1:
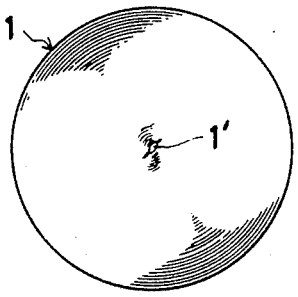
FIG. 1 is a side view of a conventional coreless toilet paper roll.
Figure 2:
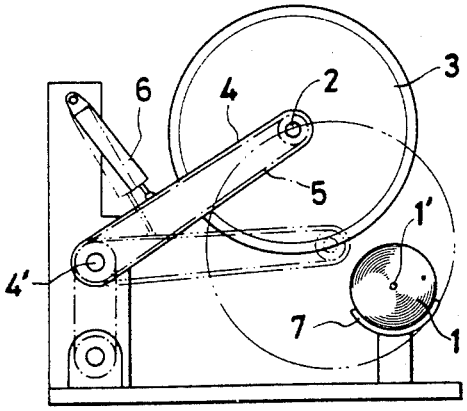
FIG. 2 is a side view of one example of a cutter for the toilet paper roll.
Figure 3:
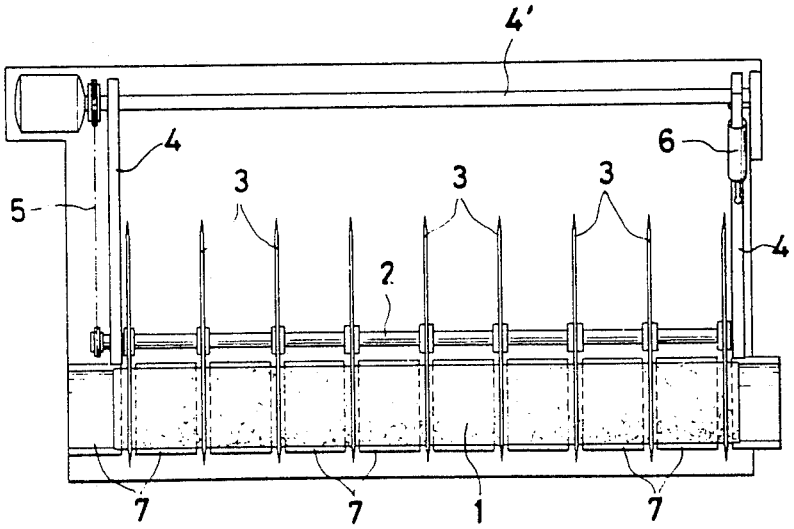
FIG. 3 is a plan view of the same.

FIG. 1 illustrates a side view of a conventional coreless toilet paper roll. A sheet of toilet paper is wound to a fixed length on a circular winding shaft of a small diameter. After the toilet paper is completely wound on the shaft, the shaft is extracted to obtain the roll body 1 having a center hole 1'. The roll body 1 is set on a cutting machine where it is cut into rolls by swinging cutting discs 3 disposed on a rotary shaft 2 at regular intervals, as illustrated in FIGS. 2 and 3. The center hole 1' made by extracting the winding shaft collapses and almost disappears due to the pressure of the cutting discs 3 on the roll body 1. The rotary shaft 2 is pivotally supported at both free ends by arms 4 and is driven by a chain transmission means 5 which is trained between a pivot 4' and one end of the rotary shaft 2. The arm 4 is pivotally swung about the pivot 4' by means of an air cylinder 6. The body 1 is laid on cradles 7 which are aligned at intervals above the bed of the cutting machine so as to be positioned between the respective cutting discs 3.

Figure 4:
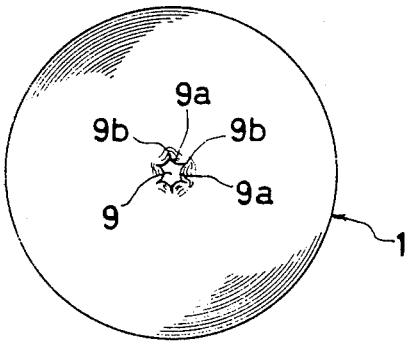
FIG. 4 is a side view of one preferred embodiment of a toilet paper roll according to the present invention.

One example of the toilet paper roll 1 according to the present invention is illustrated in FIG. 4. The roll body 1 has a center hole 9 of an approximately asterisk shape and of a size large enough to receive the stem of a toilet paper holder or the like. The principle of the method for manufacturing such a paper roll 1 will be disclosed hereinafter with reference to FIG. 5. A sheet of toilet paper P is wound around a non-circular winding shaft 8 mounted on the toilet paper manufacturing apparatus while rotating the winding shaft 8 along with a riding roller 10 which is pressed toward the shaft 8 to form a roll of toilet paper having the required number of turns as illustrated in FIG. 6. Thereafter, the winding shaft 8 is extracted from the roll of toilet paper which is then cut into short rolls 1 by a cutting device as illustrated in FIGS. 2 and 3. The winding load exerted on the toilet paper while it is being wound on the shaft 8 is constant from the beginning to the end of the winding of the paper, as is the case in the conventional winding method for a toilet paper roll having a core. The load may, of course, be gradually or stepwisely reduced with increasing diameter of the roll. When the regular hexagonal winding shaft 8 is extracted from the roll of toilet paper after the winding is completed, the remaining center hole is immediately constricted and stabilized by the force by which the paper of the roll has obtained by winding under load. Namely, this force acts to bulge portions of the roll towards the center (centripetal force) in such a manner that the inner surface of the center hole, except for the angled portions 9*b* formed by the corners on the outer surface of the winding shaft 8, that is, straight-line portions 9*a* corresponding to the sides 8*a* of the shaft 8 are slightly bulged inwardly in an arcuate shape. As a result, a hole 9 is positively retained. In such a toilet paper roll having a circular cross section, the radial length $R_1$ from the apex of each angled portion 8*b* of the winding shaft to the outer circumference thereof is smaller than the radial length $R_2$ from each side 8*a* of the winding shaft to the outer circumference thereof. Therefore, since the paper layers are equal in number at $R_1$ and $R_2$, the paper density is higher at $R_1$ than at $R_2$. Thus, the inner circumferential portion of the toilet paper being wound on the winding shaft is dented at each corner 8*b* of the winding shaft 8 to form the angled portions 9*b*. Even when the winding shaft 8 is extracted from the roll, their angled portions 9*b* keep their position, and each side portion 9*a* which is formed by a side 8*a* of the winding shaft and is low in winding density becomes bulged inwardly by the centripetal force of the roll. Consequently, the center hole 9 of the roll 1 is formed in the shape of an asterisk.

For example, when a regular hexagonal iron winding shaft 8 measuring 20 mm between opposite corners and 17 mm between opposite sides was used to manufacture a roll 1, the length between the constricted portions 9*b* of the center hole 9 of the roll 1 was about 15 mm, which is smaller by a mere 25% than the diagonal length of 20 mm of the winding shaft, whereas the length between the bulged tops of the inner circumferential portion 9*a* was about 8–9 mm which is smaller by 50% than 17 mm between opposite sides of the winding shaft.

Thereafter, in cutting the roll of toilet paper into small rolls with a cutting device, the hole 9 was not caused to collapse by the force of the cutting edge as it passed through the high density portion at the constricted portions 9*b*. The amount of deformation was so slight that a circular shaft of up to about 10 mm in diameter could easily be inserted therethrough to permit the roll to be rotatably supported on a holder. It should be noted that if the circular stem has one end or both ends thereof formed to have a somewhat smaller diameter for easy insertion, a stem of even about 15 mm in diameter can be inserted through the hole 9. as the hole 9 is somewhat expanded outwardly.

Figure 7:
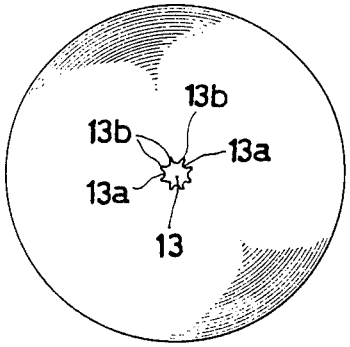
FIG. 7 is a side view of a toilet paper roll in accordance with a further embodiment of the present invention.
Figure 8:
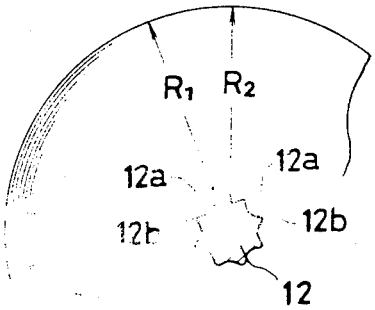
FIG. 8 is an explanatory diagram of a winding shaft used in the manufacture of the roll of FIG. 7.

FIG. 7 is a side view showing a further embodiment of the toilet paper roll in accordance with the present invention. In this case, as shown in FIG. 8, eight circularly sectioned grooves 12*a* 2 mm deep and 5.5 mm wide, are formed in the outer circumference of a round iron bar having a diameter of 20 mm. The grooves 12*a* are equally spaced about 2 mm from each other to make a winding shaft 12 having a cross-sectional shape resembling a gear, on which toilet paper is wound. The winding shaft is extracted after winding and the resulting roll is cut into short rolls by the cutter device. The winding load can be maintained constant from the beginning to the end in the customary manner or can be gradually or stepwisely reduced as the diameter increases, as described in connection with the previous embodiment.

Also, in this case, the radial length $R_1$ from the apex 12*b* between the grooves 12*a* to the outer circumference of the toilet paper roll is slightly smaller than the radial length $R_2$ from the surface of the groove 12*a* to the outer circumference and the density of the paper is higher by such amount. The inner circumferential portion of the toilet paper is forced onto the apexes 12*b* on the outer circumference of the winding shaft and wound thereabout, and the portions 13*b* in contact with the apexes 12*b* become radially depressed into a tooth profile as in the shaft 12. Accordingly, when the winding shaft 12 is removed, the remaining hole 13 shrinks but the centripetal pressure which causes the shrinkage acts mainly on the portions 13*a* which were in contact with the grooves of the winding shaft and said portion becomes bulged inwardly. After removal of the winding shaft, the diagonal length between the portions 13*b* depressed into a radial tooth profile is about 16 mm which is smaller by 20% than the 20 mm diameter of the winding shaft whereas the length between the bulged tops of the portions 13*a* is about 12 mm, which is smaller by 40%. Even if the paper roll is cut into short rolls by the cutter device, the hole 13 does not collapse under the force of the cutting edge at the portion 13*b* having a high density. Thus since the deformation is slight, a circular shaft of up to about 12 mm can be easily inserted therethrough and rotatably mounted on the holder.

In the FIG. 7 embodiment, the portion 13*b* depressed into a tooth profile is present between the inwardly bulged portions 13*a* and distanced from the adjacent portions 13*a*, whereas in the embodiment shown in FIG. 4, the inwardly bulged portion 9*a* compresses the part of the constricted portion 9*b* previously in contact with the corner of the winding shaft with those adjacent each other being in contact with each other. The center hole formed by the bulged portions as shown in FIG. 4 is less deformed than that in FIG. 7.

Figure 9:
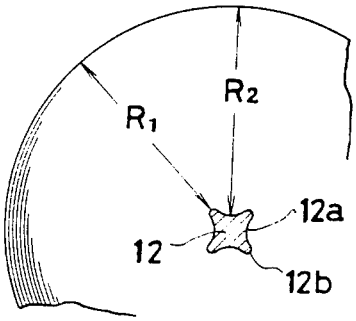
FIG. 9 is an explanatory diagram of a winding shaft and the manufacture of the roll in another embodiment of the present invention.
Figure 10:
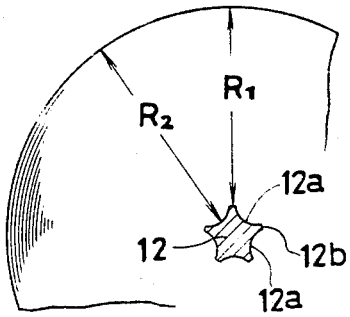
FIG. 10 is an explanatory diagram of a winding shaft and the manufacture of the roll in still another embodiment of the present invention.
Figure 11:
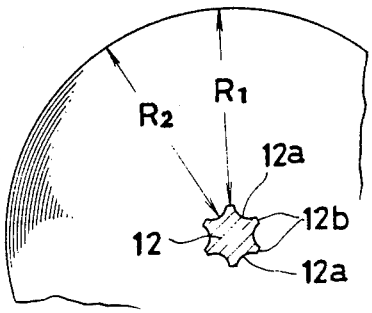
FIG. 11 is an explanatory diagram of a winding shaft and the manufacture of the roll in another embodiment of the present invention.

FIG. 9 shows a modified form of the winding shaft 12 as having a nearly square cross section whose sides are bowed inwardly. FIG. 10 shows a winding shaft 12 having a cross section resembling a pentagon, and FIG. 11 shows a winding shaft having a cross section resembling a hexagon.

By manufacturing a toilet paper roll without using a paper tube as a core, it is possible to prevent the center hole from losing its shape under external force applied to the roll or self-centripetal force, and it becomes possible to obtain a toilet paper roll of the same quality as the conventional roll, which has a center hole averaging 5 to 10 mm in diameter.

Figure 5:
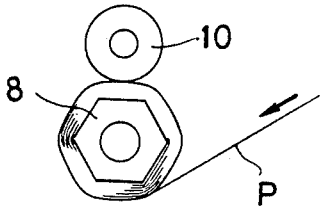
FIG. 5 is a schematic view showing the state of winding of toilet paper in one embodiment of the present invention.
Figure 6:
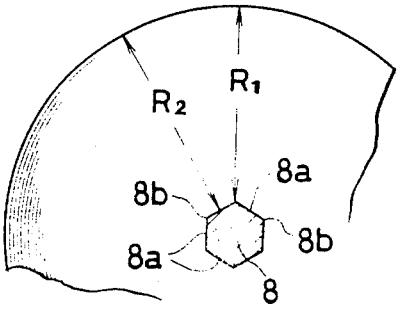
FIG. 6 illustrates the state of winding of toilet paper on the winding shaft shown in FIG. 5 to form a roll.
Figure 12:
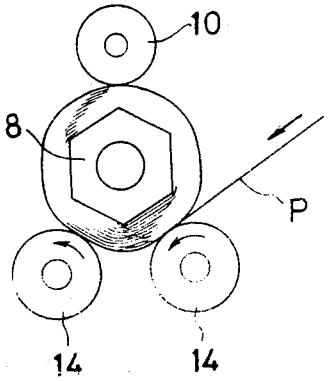
FIG. 12 schematically illustrates the surface driving winding system to which the present invention is applied.
Figure 13:
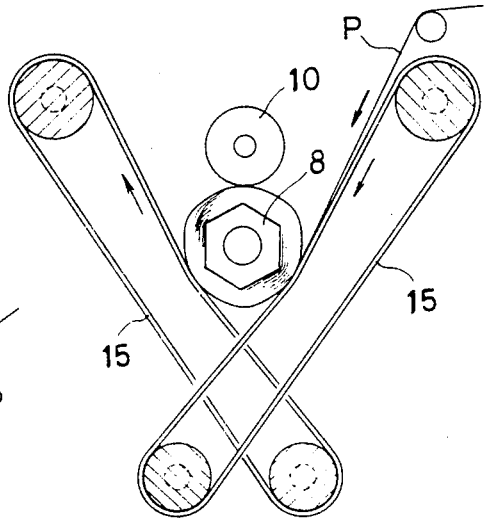
FIG. 13 schematically illustrates a further surface driving system.

The method of manufacturing such a toilet paper roll, as shown in FIG. 5, is generally called "the center driving system". Besides this method, there are so-called surface driving systems. One of the surface driving systems is composed of a winding shaft 8 arranged between a pair of rollers 14 as shown in FIG. 12. Another of the systems uses a winding shaft 8 arranged between endless belts 15 stretched in the form of the letter V or the letter X as shown in FIG. 13. In either case, a riding roller 10 rides on the winding shaft in order that the toilet paper P may be wound about the winding shaft with a predetermined winding tightness. The pressure applied by the riding roller 10 may be simply that of its own weight or that of its own weight plus that of an additional weight or the force of a piston. The riding roller is in direct contact with the winding shaft from above at the beginning. Once toilet paper is wound around the shaft, the riding roller comes into contact with the shaft through the wound toilet paper and is gradually raised with increase in winding volume of the toilet paper.

In this case, the winding shaft has a polygonal cross section like a gear. When the cornered portions corresponding to the teeth of the gear are parallel to the axis of the winding shaft, the riding roller bounds over the winding shaft due to the non-cylindrical configuration of the winding shaft until the toilet paper is amply wound on the winding shaft to assume a nearly cylindrical contour. In the case of the surface driving system, not only the riding roller but the winding shaft itself bounds over the rollers 14 or belts 15. As a result, there is a possibility that the desired winding tightness of the toilet paper is not obtained, or the winding shaft is displaced from the center, thereby causing the center hole formed by extracting the winding shaft to be made eccentric. Besides, it may happen that the toilet paper is torn widthwise during the winding, resulting in waste.

In order to overcome these problems, the present invention provides an arrangement wherein the corners of a polygonal winding shaft are spirally formed in the axial direction to minimize bounding of the riding roller or the winding shaft. This embodiment will now be described.

Figure 14:
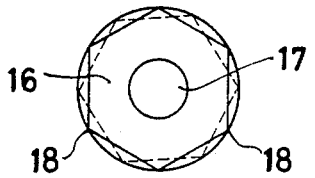
FIGS. 14(A) and 14(B) are respectively a front view and a side view showing one embodiment of the winding shaft in accordance with the present invention.
Figure 14:
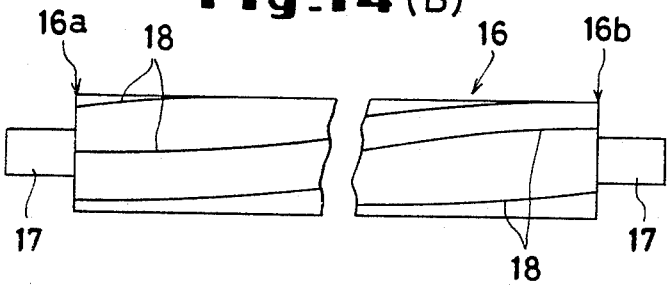

FIGS. 14(A) and 14(B) show one example of a winding shaft having a polygonal section in accordance with the present invention. Reference numeral 16 denotes a winding portion on which toilet paper of the required length is wound, and the axial length of the winding portion is determined to be somewhat longer than the width of the toilet paper to be wound, normally, about 2 m. A cylindrical spindle 17 is extended from either end of the winding portion 16. In case of the center driving system, one or both of the spindles 17 are detachably set on bearings of the winding machine to impart a rotational power thereto. In case of the surface driving system, the spindle 17 is set on the winding machine such that the shaft may be moved upwardly from the roller 14 or belt 15 as the winding takes place but one or both sides thereof can be detached from the winding machine.

The sectional shape of the winding portion 16 herein employed is a regular hexagon, and the position of each corner 18 is offset by 90° between one end 16*a* and the other end 16*b* of the winding portion. That is, each corner 18 is formed helically with a $\frac{1}{4}$ pitch. The helical pitch is not limited to $\frac{1}{4}$ relative to the full length of the winding portion, but it is preferred to determine the pitch by choosing 360°/n where n is the number of corners, such that the riding roller may rest on a part of one of corners at all times, and that, in the case of the surface driving system winding machine, the winding shaft may come into contact with the roller 14 or belt 15 at a part of one of corners at all times. For example if the winding portion is a regular hexagonal, the pitch will be 60°, namely, 1/6. It is of course possible to make the pitch smaller than 60°. For example, in the case of a regular octagon, 45° or $\frac{1}{8}$ pitch will suffice since the jumping amount is considerably reduced as compared with the prior art in which the corner is parallel to the axis.

Figure 15:
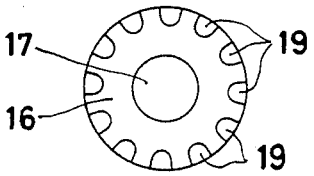
FIGS. 15(A) and 15(B) are respectively a front view and a side view showing another embodiment of the winding shaft in accordance with the present invention.
Figure 15:
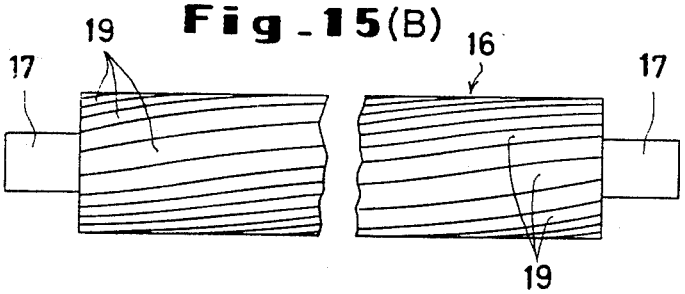

The same is true of the case of the winding shaft shown in FIGS. 15(A) and 15(B) in which the winding portion has a gear shaped section. In this embodiment, twelve teeth (or grooves) 19 are formed circumferentially in equally spaced relation helically with 1/6 pitch, which is two times of 360°/12=30°=1/12 pitch.

Most preferably, a pitch which is two or three times 360°/n as described hereinbefore is used as in such case the riding roller is always in contact with a plurality of corners to effect winding similar to a winding shaft with a cylindrical outer surface so that bounding of the riding roller (in the case of surface driving system, bounding of the winding shaft) does not occur.

As described hereinbefore, in accordance with the present invention, the aforementioned disadvantages may be eliminated by minimizing the bounding of the riding roller or the winding shaft itself from the outset of winding or effecting winding of the toilet paper without producing bounding at all. Moreover, inner circumference of the wound toilet paper is given the impression of the helical corners or teeth so that when the winding shaft is removed the portions between the portions indented by the corners or teeth are inwardly bulged to maintain an inner circumferential configuration thereof.

In removing the winding shaft, it is necessary to pull it while rotating it along the helices formed by the corners or teeth. To this end, the pitch of the helix is determined in consideration of the amount of rotation required in removal, and in view of the ease of removal, the pitch will be the amount obtained in consideration of rotation of the winding shaft, for example, two to three times, preferably within one rotation, that is, within one pitch.

Toilet paper rolls can be manufactured by one method which comprises winding a wide sheet as it is and then, after winding, cutting the resulting long roll into short rolls of predetermined length or by another method which comprises winding the wide sheet on a series of winding shafts while simultaneously slitting the sheet to a predetermined product width (for example, see Japanese Patent Publication No. 42-6007). The present invention may be applied to either of the aforesaid methods.

As described hereinbefore, in the present invention, toilet paper in wound about a winding shaft of polygonal or gear-shaped section, and after wound, the winding shaft is removed to form a toilet paper roll having an asterisk-like center hole. In this connection, in order to positively prevent the center hole of the roll from losing its shape, water or an aqueous solution containing a low concentration of an adhesive such as paste which hardens when dried, sodium celluloseglycolate (generally called CMC) and other excipients is applied at the outset of winding to wet the toilet paper. As the water (or the water content of the solution) is absorbed by the adjacent wound layers of paper during the winding, corners similar to the corners of the winding shaft appear distinctly in the inner circumferential portion of the toilet paper roll. This will be described hereinafter by way of embodiments shown in the drawings.

FIGS. 16(A) and 16(B) show an embodiment provided with a mechanism for moistening the center of a layer of wound paper on the basis of the winding system shown in FIG. 12 as one example.

A winding shaft 8 rides on and between driving rollers 14 and is frictionally rotated by means of the driving rollers 14 in a state being held by a riding roller 10 from above to wind a sheet of toilet paper P thereabout with suitable tightness utilizing the weight of the riding roller, an extra weight and the pressing force of a piston as necessary. As the winding progresses, the outside diameter of the wound roll of toilet paper increases and the winding shaft 8 is upwardly moved away from the driving rollers 14 while raising the riding roller 10. After the toilet paper has been wound to the required length, the winding shaft is stopped, the riding roller moved to a standby position, and the entire winding shaft is removed from the winding machine or one end of the winding shaft is released from the winding machine so that it can be pulled out of the roll of wound paper, after which the roll is cut into smaller rolls of predetermined length.

Directly under the space between the two driving rollers 14 is provided an upwardly directed nozzle 21 for spraying water or the aforesaid aqueous solution towards the toilet paper P at the outset of winding. By this spraying, the water content of the portions sprayed is increased by 5–7% to about 25–35% over the previous dry condition.

It is sufficient to spray the first winding or the first few windings of the toilet paper, or to spray one or a few windings following the first one or few windings. The spraying can be controlled suitably and as desired by adjustment of the nozzle 21, by use of a timer or in response to turning-on of a winding starting switch. That is, water or aqueous solution is sprayed through the nozzle for several seconds immediately after or several seconds after the switch is turned on.

Normally, it takes about 15–20 seconds to wind about 65 m of toilet paper, during which a part of the water sprayed at the outset of winding is absorbed by the layers of dry paper in the neighborhood to lightly moisten the inner peripheral region 20' of the wound paper 20 (at the termination of winding, the water content is 15–20%), and the inner peripheral region 20' is tightened about the outer circumference of the winding shaft by succeeding windings of the toilet paper externally of the inner peripheral region. A corner just along the corner 8*b* thus distinctly appears in the portion in contact with the corner 8*b* of the winding shaft.

Figure 17:
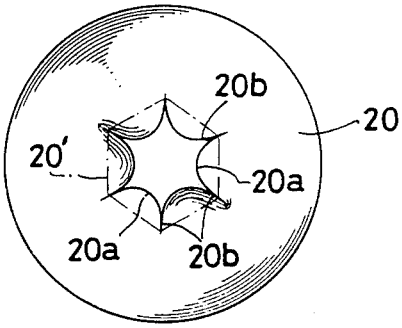
FIG. 17 schematically illustrates a roll obtained by moistening the toilet paper at the outset of winding.

Accordingly, when the winding shaft is removed after the winding has been completed, a corner 20*b* remains as it is in the inner peripheral region of the layer of wound paper to form a toilet paper roll as shown in FIG. 17 in which a portion 20*a* adjacent and between the corners 20*b* is inwardly bulged similarly to the previous embodiment 1. It should be noted that FIG. 17 shows the sectional shape of the winding shaft in broken lines to show the change in the inner peripheral region between the time before the winding shaft is removed and the time after the winding shaft has been removed.

Even if the toilet paper is not moistened at the outset of winding as in the first embodiment, the contour of the inner peripheral region after the winding shaft has been removed is not changed very much. In this case, however, since the inner peripheral region of the toilet paper roll remains dry, the fibers which consitute the toilet paper maintain their elasticity so that the corner is less distinct than in the case where moistening is carried out. On the other hand, when the inner peripheral region is lightly moistened in accordance with the present embodiment, the fibers lose their elasticity to assume the configuration as expected whereby a distinct corner appears. After the winding shaft has been removed, air flows through the resulting hole to the paper while the corner is still distinctly present.

Thus, in cutting the toilet paper roll into shorter rolls with the cutter in the subsequent step, the corners in the inner peripheral portion maintain their configuration in the manner as described, and therefore they withstand the pressing force resulting from the cutting-in of the cutter, thus producing no products in which the inner peripheral portion is collapsed. Also, the inner portion will not collapse even under shocks sustained when the products are packed into corrugated carboard boxes piled one upon another in order to prevent the boxes from breaking loose. The water content of the inner peripheral portion is about 15–20% at the termination of winding as described hereinbefore and is about 10–12% when the roll is cut into shorter rolls about 10–15 minutes after the winding shaft has been removed immediately after the termination of winding.

When, instead of water, a low concentration aqueous solution is sprayed as an excipient, the inner peripheral portion is solidified as it dries and thus such solution is more effective.

Figure 18:
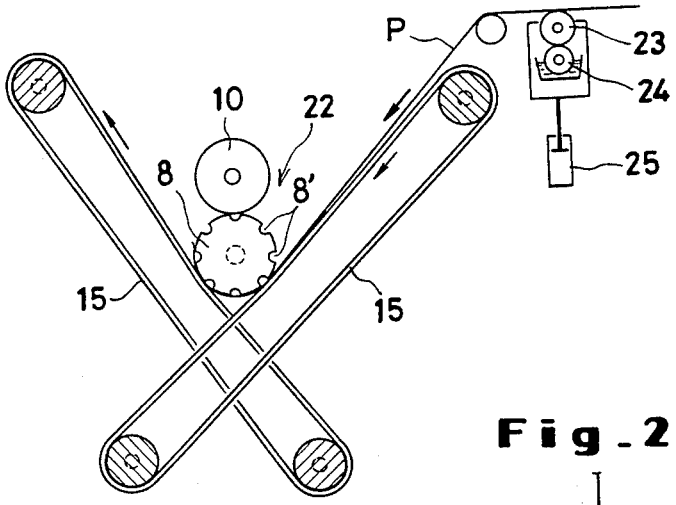
FIG. 18 schematically illustrates another embodiment using the moistening device.
Figure 19:
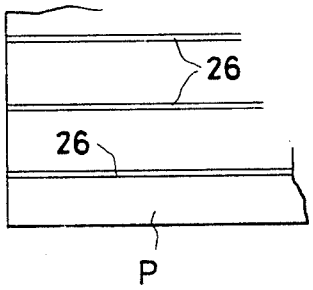
FIG. 19 is a plan view of a strip of toilet paper showing the pattern of moistening by the moistening device shown in FIG. 18.

FIG. 18 shows an arrangement wherein a moistening device is applied to the surface driving system toilet paper winding machine shown in the embodiment of FIG. 13. In this arrangement, two sets of narrow endless belts 15 are crossed into an X-shape, a winding shaft is arranged along the bottom of a valley 22 formed between the belts, the winding shaft being held by the riding roller 10, and the winding shaft is rotatably driven in one direction by the two belts to wind toilet paper thereon. Frontwardly of the upper end of one belt which forms the valley 22 there is arranged a coating roller 23 for applying water or the like in the form of longitudinal stripes on the toilet paper downwardly moving into the valley while maintaining the spacing widthwise, and a liquid supply device is provided in which water or the like is applied to the coating surface of the coating roller by means of a liquid supply roller 24 half of which is immersed in a vat filled with water or the like. Then, the device is raised by means of a cylinder 25 for a predetermined short period of time at the outset of winding, water or the like is applied to the toilet paper by the coating roller 23 to form water stripes 26 (FIG. 19), and after the lapse of the specified time the cylinder is moved down to disengage the device from the toilet paper.

The amount of water used for forming the water stripes, the width of the stripes and the spacing between the stripes are determined such that the whole portion in the width direction is moistened about when the stripes have moved down to the valley bottom and are wound about the winding shaft, and care should be taken so that the toilet paper is not cut widthwise prior to winding of the stripes about the winding shaft.

During the course of winding, water or the like applied at the outset of winding propagates to the wound paper in the neighborhood to lightly moisten the inner peripheral portion and therefore, a distinct corner just along the corner on the outer circumference of the winding shaft appears in the inner peripheral portion and even after the winding shaft is removed, the corner maintains its configuration, whereby the inner peripheral portion does not collapse.

While in this embodiment, the winding portion of the winding shaft is in the form of the gear-shaped section having the teeth 8', it should be appreciated that a polygonal section can be also used similarly to the aforementioned embodiments.

Figure 16:
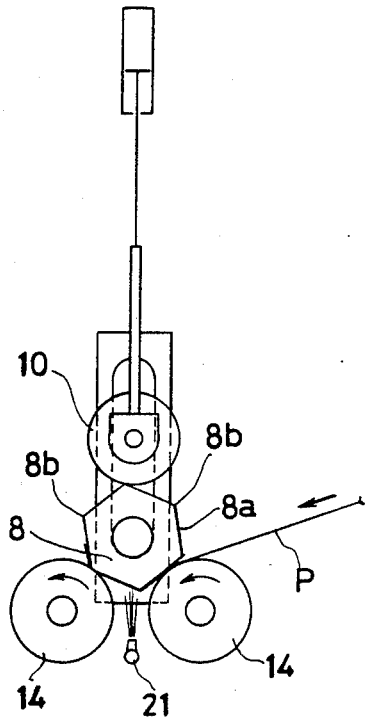
FIGS. 16(A) and 16(B) schematically illustrate the beginning and termination of winding in the case where a moistening device is used in accordance with one embodiment of the present invention.
Figure 16:
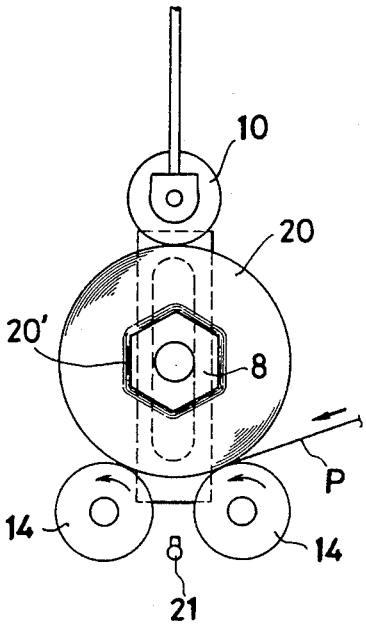
Figure 20:
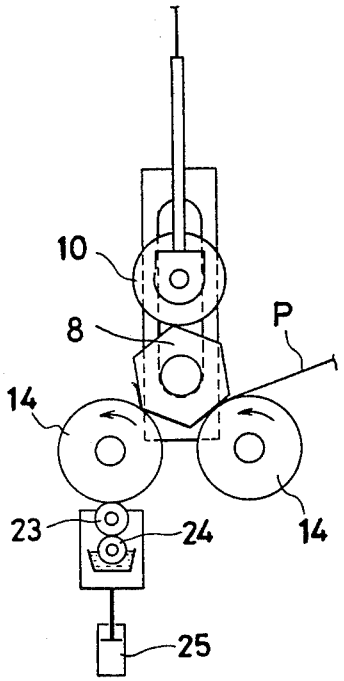
FIG. 20 schematically illustrates still another embodiment using the moistening device.

The embodiment shown in FIG. 20 uses the moistening device comprising the coating roller 23, the liquid supply roller 24, and the like, of the embodiment of FIG. 18, in place of the nozzle 21 in the arrangement of FIG. 16. The coating roller 23 is disposed so that it may come into contact with one of the driving rollers 14, and the cylinder 25 is driven for a suitable period of time to bring the coating roller 23 into contact with the driving roller 14 to thereby impart a suitable amount of water to the toilet paper P through the roller 14. Similar effects to those of the embodiments shown in FIGS. 16 and 18 can be attained.

In the embodiments which use these moistening devices, the number of corners of the polygon of the winding shaft and the number of teeth of the gear-shape section may be suitably determined depending on the outside diameter of the winding shaft. For example, to form an inner peripheral portion whose average inside diameter is greater than 25 mm, the number of corners or the number of teeth should be more than ten, preferably, 12 to 16.

As described above, if the toilet paper is lightly moistened when it is wound, the corners formed by the corners of the outer circumstance of the winding shaft may be distinctly produced in the center hole of the roll to maintain the configuration of the inner peripheral portion, and therefore even a center hole which has a relatively large average inside diameter, larger than about 25 mm, may be produced.

As is apparent from the foregoing, method of manufacturing a toilet paper roll in accordance with the present invention can positively produce a hole by removing the winding shaft after winding, and, therefore, the shaft for mounting the roll on a holder may be easily passed therethrough. Moreover, the toilet paper roll produced matches the generally accepted concept of a toilet paper roll having a hole at the center. What is more, the shape of the hole is not a mere circle but can be variously changed depending on the sectional shape of the winding shaft. Thus the hole itself can also serve as a kind of ornament.

In addition, since a paper tube is not used, the products may be manufactured at a cost lower by the price of the tube. After the paper is used up, nothing remains so that there is no danger of such troubles as the stopping-up of the toilet by a paper tube. If a smaller diameter of the winding shaft is used, a longer sheet of toilet paper, nearly twice as long as that on a conventional roll having a tube, can be wound within the same outside diameter.

Furthermore, prior art toilet paper manufacturing machines may be used for carrying out the method of this invention without modification merely by replacing the winding shaft.

It is known from Japanese Patent Publication No. 42-6007 that a broad sheet of toilet paper can be wound while slitting it into predetermined product widths by means of a cutting roll. In this case, there is no need to cut a long toilet paper roll into shorter rolls as in the case where an axially long toilet paper roll is manufactured. The toilet paper is wound directly on the winding shaft having a circular section while slitting it to predetermined widths, after which each short roll is removed from the winding shaft leaving a circular hole at the center. However, this circular hole will collapse to a semicircle under the shocks and pressure occurring when the rolls are packed into cardboard boxes for transportation and storage, or by the pressure of ropes or cords used to bind stacks of the cardboard boxes to prevent them from breaking loose. In this case, the external shape of the product also changes. However, when the original sheet of toilet paper is wound on the winding shaft of a polygon or gear-shaped sectional shape while being slit to predetermined widths in accordance with the present invention, it is possible to prevent the hole of the inner peripheral portion and the external shape from being deformed when the products are transported and stored. Moreover, the toilet paper wound on the winding shaft does not press onto all parts of the outer circumference of the winding shaft evenly as is the case when using a circular winding shaft and thus the present winding shaft may be removed more easily than a circular winding shaft.

Furthermore, in accordance with the present invention, the corners or teeth provided on the winding shaft are twisted into a helical configuration, thereby minimizing or completely preventing bounding of the riding roller when the paper is wound on the non-circular winding shaft. Therefore, the quality of the toilet paper roll is not deteriorated and the occurrence of vibration and noise during the winding can be minimized.

In addition, water or a solution containing paste or the like is applied to toilet paper to be wound at the outset of winding or at suitable time thereafter, whereby a center hole having polygonal or gear-shaped corners may be secured in nearly perfect condition so that there is no danger of the hole being pressed out of shape during normal handling.

Obviously, many modifications and variations of the present invention are possible in light of the above teachings. It is therefore to be understood that within the scope of the appended claims, the present invention may be practiced otherwise than as specifically as described herein.

What is claimed is:

1. A coreless paper roll, comprising:

a roll of paper wherein the innermost plies of said roll of paper define a substantially rigidified, non-collapsible aperture, having a substantially polygonal cross-sectional configuration, capable of removably accommodating a paper holder which can rotatably support said coreless paper roll, and wherein further, all of said paper of said paper roll, including said innermost plies of said roll of paper which define said paper roll aperture, is capable of being readily unrolled for a predetermined paper use, said substantially polygonally shaped, substantially rigidified, non-collapsible aperture being defined by means of circumferentially arranged, alternatively disposed, radially outwardly extending constrictions, and radially inwardly extending bulged portions which have been partially collapsed radially inwardly to a predetermined final extent.

2. The coreless paper roll according to claim 1, wherein the constrictions of said aperture are acutely angled and the adjacent bulged portions are in contact with one another.

3. The coreless paper roll according to claim 1 wherein the constrictions of said aperture are arcuately divergent and the adjacent bulged portions are separated from one another by said constrictions.

4. A coreless paper roll as set forth in claim 1, wherein:

said roll of paper comprises toilet tissue.

5. A coreless paper roll as set forth in claim 1, wherein:

said aperture has an asterisk configuration.

6. A coreless paper roll as set forth in claim 1, wherein:

said aperture has a substantially hexagonal configuration.

7. A coreless paper roll as set forth in claim 1, wherein:

said aperture has a substantially square-shaped configuration.

8. A coreless paper roll as set forth in claim 1, wherein:

said aperture has a substantially pentagonal configuration.

9. A method for manufacturing a coreless paper roll comprising the steps of:

mounting a winding shaft, having a polygonally shaped cross-sectional configuration defined by alternative apex and side-surface portions, upon a winding machine;

engaging a free end of said paper upon said winding shaft;

rotating said winding shaft so as to coil said paper over and about said apex and side-surface portions of said winding shaft and thereby form a coreless roll of paper wherein all of said paper of said coreless paper roll, including the innermost plies of said paper roll, is capable of being readily unrolled for a predetermined paper use; and removing said winding shaft from said roll of paper so as to permit those portions of said paper roll initially in engagement with said side-surface portions of said winding shaft to partially collapse radially inwardly under the influence of centripetal force through means of a predetermined final extent and thereby form radially inwardly extending bulged portions, while those portions of said paper initially in engagement with said apex portions of said winding shaft simultaneously form radially outwardly extending constrictions, whereby a substantially rigidified, non-collapsible central aperture of said coreless paper roll is defined by said innermost plies of said paper roll so as to be capable of removably accommodating a paper roll holder.

10. A method for manfacturing a coreless paper roll as claimed in claim 9, wherein during the winding of the paper, a riding roller is used to apply to the roll of paper being wound a fixed pressure as the thickness of the roll of paper increases.

11. A method of manufacturing a coreless paper roll as claimed in claim 9, wherein the corners of the polygonal winding shaft are parallel to the axis of the shaft.

12. A method for manufacturing a coreless paper roll as claimed in claim 9, wherein the corners of the polygonal winding shaft are helical with respect to the shaft, and at the completion of winding the paper roll, the winding shaft is removed from the roll while being rotated.

13. A method for manufacturing said coreless paper roll as set forth in claim 9, wherein:

said paper roll comprises toilet tissue.

14. A method for manufacturing a coreless paper roll as set forth in claim 9, wherein:

during the winding of the paper, a riding roller is used to apply to the roll of paper being wound a pressure which decreases as the thickness of the roll of paper increases.

15. A method for manufacturing a coreless paper roll comprising the steps of:

mounting a winding shaft, having a gear-shaped cross-sectional configuration defined by alternative teeth and groove portions, upon a winding machine;

engaging a free end of said paper upon said winding shaft;

rotating said winding shaft so as to coil said paper over and about said teeth and groove portions of said winding shaft and thereby form a coreless roll of paper wherein all of said paper of said coreless paper roll, including the innermost plies of said paper roll, is capable of being readily unrolled for a predetermined paper use; and removing said winding shaft from said roll of paper so as to permit those portions of said paper roll initially in engagement with said groove portions of said winding shaft to partially collapse radially inwardly under the influence of centripetal force through means of a predetermined final extent and thereby form radially inwardly extending bulged portions, while those portions of said paper initially in engagement with said teeth portions of said winding shaft simultaneously form radially outwardly extending constrictions, whereby a substantially rigidified, non-collapsible central aperture of said coreless paper roll is defined by said innermost plies of said paper roll so as to be capable of removably accommodating a paper roll holder.

16. A method for manufacturing a coreless paper roll as claimed in claim 9 or 15, wherein when the paper is wound on said winding shaft, the paper is moistened at the outset of winding with water or an aqueous solution containing an adhesive or excipient.

17. A method as set forth in claim 16, wherein:

said water or aqueous solution is applied to said paper in the form of stripes extending longitudinally along the length of said paper.

18. A method for manufacturing said coreless paper roll as set forth in claim 15, wherein:

said paper roll comprises toilet tissue.

19. A method for manufacturing a coreless paper roll as claimed in claim 15, wherein the teeth of the gear-shaped winding shaft are parallel to the axis of the shaft.

20. A method for manufacturing a coreless paper roll as claimed in claim 11 or 19 wherein when the paper is wound on said winding shaft, the paper is moistened at the outset of winding with water or an aqueous solution containing an adhesive or excipient.

21. A method for manufacturing a coreless paper roll as claimed in claim 15, wherein the teeth of the gear-shaped winding shaft are helical with respect to the shaft, and at the completion of winding the paper roll, the winding shaft is removed from the roll while being rotated.

22. A method for manufacturing a coreless paper roll as claimed in claim 12 or 21 wherein when the paper is wound on said winding shaft, the paper is moistened at the outset of winding with water or an aqueous solution containing an adhesive or excipient.

* * * * *